US011656018B2

(12) United States Patent
Chen et al.

(10) Patent No.: US 11,656,018 B2
(45) Date of Patent: May 23, 2023

(54) ICE MAKING SYSTEM AND REFRIGERATION APPARATUS

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventors: Xing Chen, Anhui (CN); Yang Shao, Anhui (CN); Zanxi Liu, Anhui (CN); Jincai Wang, Anhui (CN); Zengqiang Si, Anhui (CN); Mingxing Sun, Anhui (CN); Cunyu Liu, Anhui (CN); Gang Cui, Anhui (CN)

(73) Assignee: MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 17/433,587

(22) PCT Filed: Dec. 30, 2019

(86) PCT No.: PCT/CN2019/129832
§ 371 (c)(1),
(2) Date: Aug. 24, 2021

(87) PCT Pub. No.: WO2021/134174
PCT Pub. Date: Jul. 8, 2021

(65) Prior Publication Data

US 2022/0325934 A1 Oct. 13, 2022

(51) Int. Cl.

| | |
|---|---|
| ***F25C 1/12*** | (2006.01) |
| ***F25C 5/18*** | (2018.01) |
| ***F25C 1/24*** | (2018.01) |

(52) U.S. Cl.
CPC ..... *F25C 1/24* (2013.01); *F25C 1/12* (2013.01); *F25C 5/18* (2013.01); *F25C 2500/06* (2013.01)

(58) Field of Classification Search
CPC .... F25C 1/12; F25C 2500/06; F25C 2400/04; F25C 1/24; F25C 5/18
See application file for complete search history.

(56) References Cited

U.S. PATENT DOCUMENTS 4,365,485 A 12/1982 Samuelsen
4,986,088 A * 1/1991 Nelson ..... F25C 1/12 62/347

(Continued)

FOREIGN PATENT DOCUMENTS

CN 1601210 A 3/2005
CN 1629571 A 6/2005

(Continued)

OTHER PUBLICATIONS

International Search Report dated Sep. 1, 2020 for PCT Application No. PCT/CN2019/129832, filed Dec. 30, 2019, 8 pages.

*Primary Examiner* — Cassey D Bauer
(74) *Attorney, Agent, or Firm* — Seed IP Law Group LLP

(57) ABSTRACT

The present application relates to the field of ice making, and provides an ice making system and a refrigeration apparatus. The ice making system includes an ice making assembly, a water collecting tank located below the ice making assembly, and a water diversion ice rake structure. The water diversion ice rake structure includes: a pair of water receiving lateral wings, each of which is constructed with a rotary end and a free end; the pair of water receiving lateral wings are rotatably disposed on opposite sides of the ice making assembly through the respective rotary ends to rotate between an ice making position and an ice falling position. At the ice making position, the free ends of the pair of water (Continued)

receiving lateral wings are butted in a space between the ice making assembly and the water collecting tank to form a closure space with an opening facing the ice making assembly, and a water outlet communicating with the water collecting tank is constructed on one side of the closure space. The present application may solve the problems of condensed water dripping out and water splashing outward during ice making.

20 Claims, 6 Drawing Sheets

(56) References Cited

U.S. PATENT DOCUMENTS

| | | | |
|---|---|---|---|
| 2004/0226311 | A1 | 11/2004 | Ishitomi et al. |
| 2008/0053112 | A1 | 3/2008 | Higashitani et al. |
| 2008/0209937 | A1 | 9/2008 | Wu et al. |

FOREIGN PATENT DOCUMENTS

| | | | |
|---|---|---|---|
| CN | 101231057 | A | 7/2008 |
| CN | 101315240 | A | 12/2008 |
| CN | 101982717 | A | 3/2011 |
| CN | 102183118 | A | 9/2011 |
| JP | 2003-343948 | A | 12/2003 |
| KR | 10-2011-0054759 | A | 5/2011 |

* cited by examiner

ICE MAKING SYSTEM AND REFRIGERATION APPARATUS

BACKGROUND

Field of Technology

The present application relates to the technical field of ice making, and in particular to an ice making system and a refrigeration apparatus.

Description of the Related Art

The traditional principle of ice making is to inject water into an ice tray through a water hose, and then refrigerate the ice tray through an evaporator and/or air cooling, such that the water in the ice tray is slowly condensed into ice cubes which are stored in an ice storage box after deicing.

BRIEF SUMMARY

The inventors of the present disclosure have appreciated that when water is injected into the ice tray in the ice making process, it is prone to splashing outward and dripping down into the ice storage box due to the pressure and impact of the water, thereby affecting the quality of the ice cubes. One or more embodiments of the present disclosure (also referred to as the present application) addresses at least one of the technical problems in the prior art or related art. One or more embodiments of the present application provide an ice making system, to solve the problem of water splashing outwards during ice making as well as other problems in the related art.

The present application further provides a refrigeration apparatus.

In a first aspect, an embodiment of the present application provides an ice making system, including an ice making assembly, a water collecting tank located below the ice making assembly, and a water diversion ice rake structure; the water diversion ice rake structure includes: a pair of water receiving lateral wings, each of which is constructed with a rotary end and a free end; the pair of water receiving lateral wings are rotatably disposed on opposite sides of the ice making assembly through the respective rotary ends to rotate between an ice making position and an ice falling position; wherein at the ice making position, the free ends of the pair of water receiving lateral wings are butted in a space between the ice making assembly and the water collecting tank to form a closure space with an opening facing the ice making assembly, and a water outlet communicating with the water collecting tank is formed on one side of the closure space; and wherein at the ice falling position, the free ends of the pair of water receiving lateral wings are separated from each other to form an ice falling port.

In the ice making system of the embodiment of the present application, a water diversion ice rake structure is provided on the basis of the traditional ice making system, and a pair of water receiving lateral wings may form a closure space by being butted in the space between the ice making assembly and the water collecting tank during ice making, so that both the condensed water formed on the sides and bottom of the ice making assembly and the water splashed outward from the ice making assembly during ice making may fall into the closure space, thereby effectively solving the problems of condensation water dripping out and water splashing during ice making.

According to an embodiment of the present application, the ice making system further includes an ice storage box located below the ice making assembly, and an ice inlet is provided at an upper end of the ice storage box; wherein at the ice falling position, the free ends of the pair of water receiving lateral wings are separated from each other to form an ice falling passage from the ice falling port toward the ice inlet.

According to an embodiment of the present application, a pair of ice inlets are disposed at intervals at the upper end of the ice storage box, the water collecting tank is disposed above a position between the pair of ice inlets, and the length direction of the water collecting tank is along the length direction of the ice storage box; ice doors are hinged on outer sides of the pair of ice inlets on the ice storage box.

According to an embodiment of the present application, the ice making assembly includes at least one ice tray, and the at least one ice tray includes a plurality of ice tray units disposed side by side.

According to an embodiment of the present application, the ice making assembly includes a pair of ice trays, and backsides of the pair of ice trays are disposed opposite to each other.

According to an embodiment of the present application, the water diversion ice rake structure further includes ice rake teeth which are provided at the rotary end of at least one of the water receiving lateral wings, the ice rake teeth are inclined toward a water flowing surface of the ice tray, and top ends of the ice rake teeth are close to a water inlet of the ice tray.

According to an embodiment of the present application, the ice rake tooth tapers from its root outward along a length direction to form a tip.

According to an embodiment of the present application, the ice tray includes a plurality of ice tray units disposed side by side, a plurality of ice rake teeth are disposed at intervals along a length direction of the rotary end of the water receiving lateral wing, and the plurality of ice rake teeth are in one-to-one correspondence with the plurality of ice tray units.

According to an embodiment of the present application, each of the pair of water receiving lateral wings includes a water stopping side wall extending downward along the respective rotary end and a water receiving side wall extending to the opposite from the water stopping side wall and inclined downward; and a bottom end of the water receiving side wall is provided with a downwardly extending flanging.

According to an embodiment of the present application, a bottom end of at least one of the water receiving side wall is provided with a sealing structure extending to the flanging.

According to an embodiment of the present application, the water receiving side wall is constructed to be inclined toward the water outlet, and a side located at the water outlet of the water receiving side wall is open and a side away from the water outlet thereof is provided with a shielding wall.

According to an embodiment of the present application, each of the rotary ends of the pair of water receiving lateral wings is provided with a rotary shaft having an axial direction extending along a length direction of the ice making assembly.

According to an embodiment of the present application, the ice making system further includes a driving mechanism which is connected with the rotary shaft of one of the water receiving lateral wings, and the rotary shafts of the pair of the water receiving lateral wings are connected to each other through a linkage.

According to an embodiment of the present application, the ice making assembly further includes a water outflow mechanism, the water outflow mechanism includes a water distributor which supplies water to each ice tray unit through water distribution branch hoses in one-to-one correspondence with the ice tray units; the water collecting tank is connected to a water tank through a drain hose, a water pump is provided on the drain hose, and the water distributor is connected to the water tank; and a water stopper is provided on an outer side of a communication between the water outlet and the water collecting tank.

An embodiment of a second aspect of the present application further provides a refrigeration apparatus, which includes the ice making system described in the above technical solutions.

Since the refrigeration apparatus of the embodiment of the present application includes the above-mentioned ice making system, it has all the advantages of the above-mentioned ice making system, and the advantages will not be repeated here.

Additional aspects and advantages of the present application will be given in part in the following description, and some will be obvious from the following description, or be learned through the practice of the present application.

BRIEF DESCRIPTION OF THE SEVERAL VIEWS OF THE DRAWINGS

In order to more clearly illustrate the technical solutions disclosed in the embodiments of the present application or the prior art, the drawings needed in the descriptions of the embodiments or the prior art will be briefly introduced below. Obviously, the drawings in the following description only show some embodiments of the present application, and other drawings can be obtained according to the drawings without any creative work by those skilled in the art.

Figure 1:
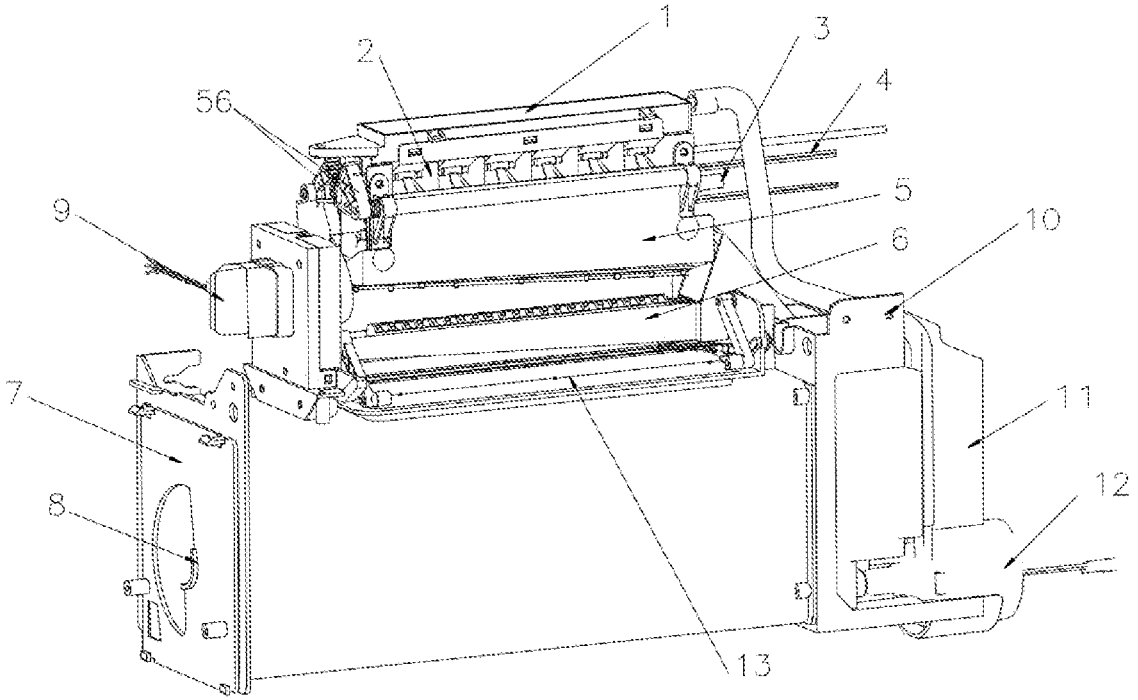
FIG. 1 is a schematic diagram showing the overall structure of an ice making system according to an embodiment of the present application.
Figure 2:
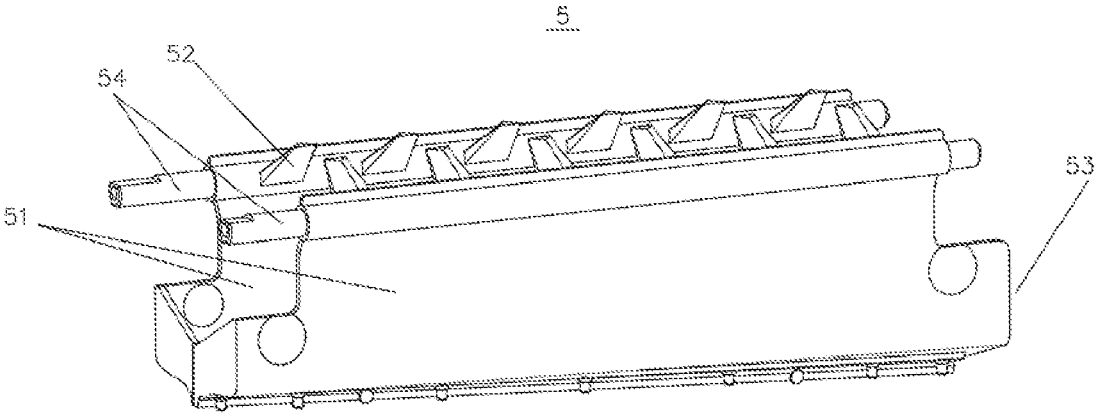
FIG. 2 is a schematic diagram showing the overall structure of a water diversion ice rake structure in an ice making system according to an embodiment of the present application.
Figure 3:
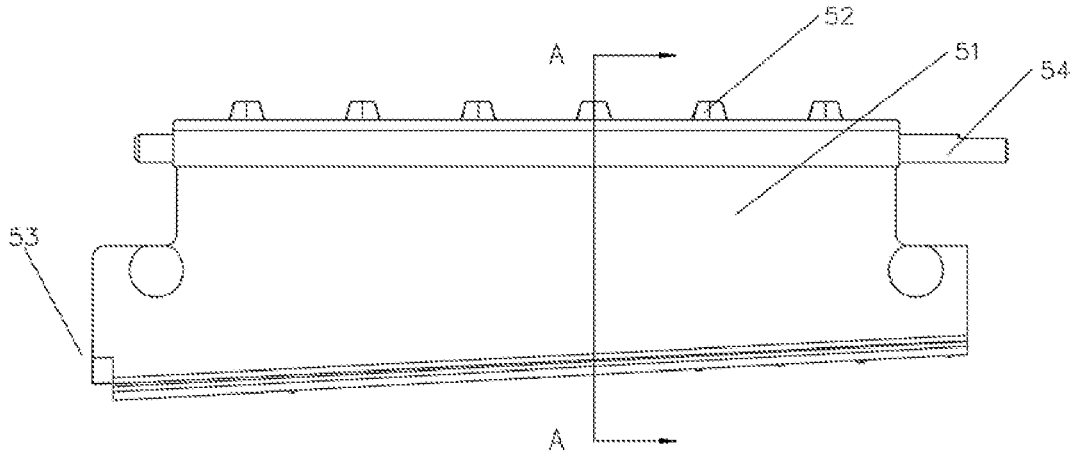
FIG. 3 is a front view of a water diversion ice rake structure in an ice making system according to an embodiment of the present application.
Figure 4:
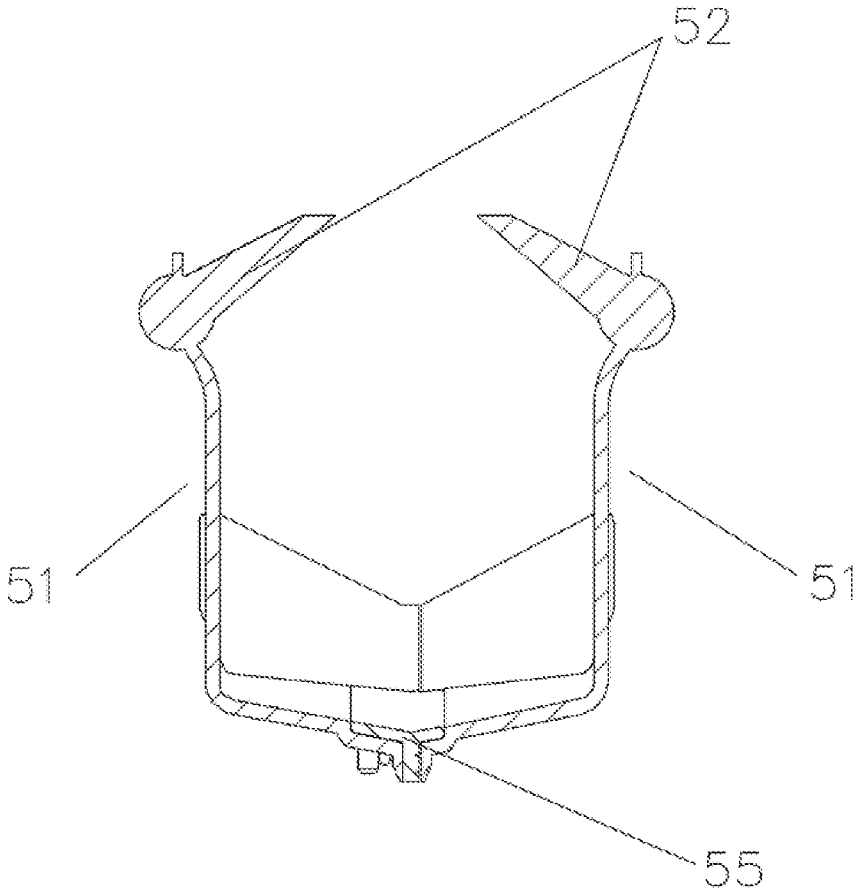
FIG. 4 is a cross-sectional view of A-A in FIG. 3.
Figure 5:
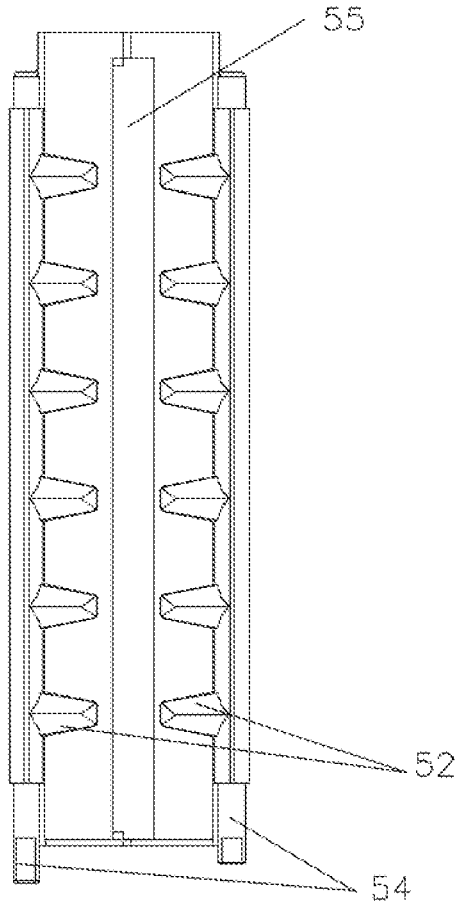
FIG. 5 is a top view of a water diversion ice rake structure in an ice making system according to an embodiment of the present application.

| Reference Numerals: | |
|---|---|
| 1 water distributor | 2 ice tray |
| 3 evaporator | 4 heating wire |
| 5 water diversion ice rake structure | 51 water receiving lateral wing |
| 51-1 water stopping side wall | 51-2 water receiving side wall |
| 51-3 flanging | 51-4 shielding wall |
| 52 ice rake teeth | 53 water outlet |
| 54 rotary shaft | 55 sealing structure |
| 56 linkage | 6 water collecting tank |
| 7 ice storage box | 71 ice door |
| 8 ice discharging mechanism | 9 driving motor |
| 10 water valve | 11 water tank |
| 12 water pump | 13 observation door |

DETAILED DESCRIPTION

Implementations of the present application are further described in detail below in conjunction with accompanying drawings and embodiments. The following embodiments are used to illustrate the present application, but cannot be used to limit the scope of the present application.

In the description of the embodiments of the present application, it should be noted that the orientations or positional relationships indicated by the terms "center," "longitudinal," "lateral," "upper," "lower," "front," "back," "left," "right," "vertical," "horizontal," "top," "bottom," "inner" and "outer," etc., are based on the orientation or positional relationship shown in the drawings, the purpose of which is only to facilitate describing the embodiments of the present application and simplify the description, rather than to indicate or imply that the device or element referred to must have a specific orientation, be constructed and operated in a specific orientation, and therefore cannot be construed as a limitation of the embodiments of the present application. In addition, the terms "first," "second" and "third" are for descriptive purpose only, and cannot be understood as indicating or implying the relative importance.

In the description of the embodiments of the present application, it should be noted that unless otherwise clearly specified or defined, the terms "connect with" and "connect to" should be understood in a broad sense, for example, it can be a fixed connection or a detachable connection, or an integral connection; it can be mechanically connected or electrically connected; it can be directly connected or indirectly connected through an intermediary. For those of ordinary skill in the art, the specific meaning of the above terms in the embodiments of the present application can be understood according to the specific situations.

In the embodiments of the present application, unless otherwise clearly specified or defined, the first feature being "above" or "below" the second feature may mean that the first and second features are in direct contact, or the first and second features are in indirect contact through an intermediary. Moreover, the first feature being "above," "on" or "over" the second feature may be that the first feature is directly above or diagonally above the second feature, or may indicate only that the level of the first feature is higher than that of the second feature. The first feature being "below," "under" or "beneath" the second feature may be that the first feature is directly below or diagonally below the second feature, or may indicate only that the level of the first feature is lower than that of the second feature.

In the description of this specification, the reference terms "one embodiment," "some embodiments," "examples," "specific examples," "some examples" or the like mean that the specific features, structures, materials or characteristics described in conjunction with the embodiments or examples are included in at least one embodiment or example of the present application. In this specification, the schematic representations of the above-mentioned terms do not necessarily refer to the same embodiment or example. Moreover, the described specific features, structures, materials or characteristics can be combined in any one or more embodiments or examples in a suitable manner. In addition, those skilled in the art can combine the different embodiments or examples and the features of the different embodiments or examples described in this specification without mutual contradiction.

In a first aspect, FIG. 1 is a schematic diagram showing the overall structure of an ice making system according to an embodiment of the present application. As shown in FIG. 1, the ice making system provided by the embodiment of the present application includes an ice making assembly and a water collecting tank 6 located below the ice making assembly. The ice making assembly is configured to make ice, and the water collecting tank 6 is configured to collect ice making water in the ice making process. Here, "the water collecting tank 6 located below the ice making assembly" means that the water collecting tank 6 is located below the ice making assembly in the direction of water flow. It is not required that the water collecting tank 6 is located directly below the ice making assembly, but the water collecting tank 6 may also be located diagonally below the ice making assembly, which is also within the protection scope of the present application.

In the ice making process, the ice making water will splash outside under the action of impact force and drip onto other parts. In addition, the temperature in the ice making system is lower than 0° C., therefore, in this process, it is easy to produce condensed water on the internal components of the ice making system, such as the side walls and bottom of the water distributor, which drips into the ice storage box.

Accordingly, in some embodiments, a water diversion ice rake structure 5 is further included in this embodiment. FIGS. 2 to 5 are schematic structural diagrams of the water diversion ice rake structure according to an embodiment of the present application. As shown in FIGS. 2 to 5, the water diversion ice rake structure 5 includes:

a pair of water receiving lateral wings 51, each of which is constructed with a rotary end and a free end. As shown in FIG. 1, an upper end of the water receiving lateral wing 51 is the rotary end, a lower end of the water receiving lateral wing 51 is the free end, and the pair of water receiving lateral wings 51 are rotatably disposed on opposite sides of the ice making assembly through the respective rotary ends to rotate between an ice making position and an ice falling position.

Here, it should be noted that the "ice making position" refers to a position where the pair of water receiving lateral wings 51 are located during the ice making process of the ice making assembly, and the "ice falling position" refers to a position where the pair of water receiving lateral wings 51 are located when ice cubes fall during the deicing process of the ice making assembly. For a pair of water receiving lateral wings 51, when they are in the above-mentioned different positions, they will be configured into different configurations and states, and these configurations and states will be described in more detail below in conjunction with the accompanying drawings.

Here, it should also be noted that the "opposite sides of the ice making assembly" may specifically means that a pair of water receiving lateral wings 51 are arranged on opposite sides along the length direction of the ice making assembly, or a pair of water receiving lateral wings 51 are arranged on the opposite sides along the width direction of the ice making assembly. Of course, a pair of water receiving lateral wings 51 may also be arranged in other suitable positions. In the present embodiment, a case where the pair of water receiving lateral wings 51 are arranged on opposite sides of the ice making assembly along the length direction is taken as an example for description.

Figure 9:
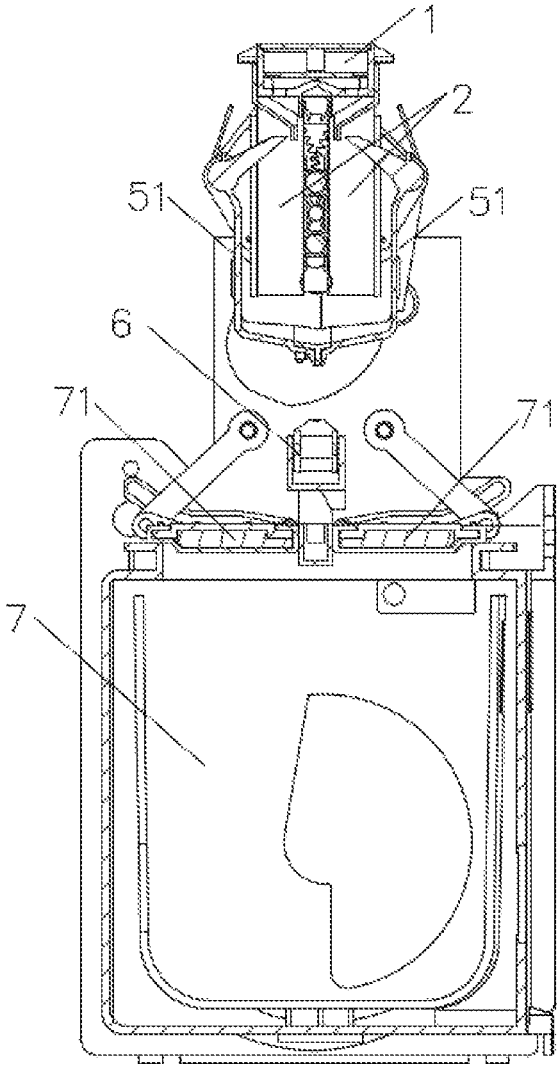
FIG. 9 is a longitudinal cross-sectional view of a water diversion ice rake structure in an ice making system at an ice making position according to an embodiment of the present application.

FIG. 9 is a longitudinal cross-sectional view of a water diversion ice rake structure at an ice making position according to the present embodiment. As shown in FIG. 9, at the ice making position, the free ends of the pair of water receiving lateral wings 51 are butted in the space between the ice making assembly and the water collecting tank 6 to form a closure space, and the opening of the closure space faces the ice making assembly. One side of the closure space is constructed as a water outlet 53 which communicates with the water collecting tank 6. As a result, the water collected in the closure space will be discharged into the water collecting tank 6 through the water outlet 53 for collection, which facilitates the reuse.

In the ice making system of the embodiment of the present application, a water diversion ice rake structure 5 is provided on the basis of the traditional ice making system, and a pair of water receiving lateral wings 51 are butted between the ice making assembly and the water collecting tank 6 to form a closure space during ice making, so as to intercept the condensed water formed from the sides and bottom of the ice making assembly and the water splashing out of the ice making assembly during ice making, the intercepted water may fall into the closure space, thereby effectively solving the problems of condensed water dripping out and water splashing during ice making.

Wherein the "water splashing out" includes the water splashed out when the water flow in the ice making assembly scour the ice tray 2 and the water splashed out of the water collecting tank 6 when the water flow enters the water collecting tank 6 during ice making.

The condensed water may be produced on the surfaces of the ice tray 2 and the water outflow mechanism in the ice making assembly. Of course, other components inside the ice making system will also have condensed water.

Wherein, at the ice falling position, the free ends of the pair of water receiving lateral wings 51 are separated from each other to form an ice falling port. After ice making is completed, the ice cubes are dropped from the ice falling port and stored.

In this embodiment, the closure space is provided between the ice making assembly and the water collecting tank 6, and covers at least the two sides and bottom of the ice making assembly, so as to ensure that both the water splashed out due to the water flow scouring the ice tray 2 and the condensed water generated on the two sides and bottom of the ice making assembly fall into the closure space. In addition, since the water flow does not directly flow into the water collecting tank 6, water may be prevented from splashing outward from the water collecting tank 6.

In order to ensure the water receiving effect of the water receiving lateral wings 51, the orthographic projection area of the closure space is larger than the orthographic projection area of the ice making assembly.

In order to facilitate the storage of ice cubes, according to an embodiment of the present application, the ice making system further includes an ice storage box 7 located below the ice making assembly. The ice storage box 7 is provided with an ice inlet at an upper end, and the ice cubes having been deiced by the ice making assembly fall into the ice storage box 7 from the ice inlet and are stored in the ice storage box 7.

In the prior art, when ice cubes fall into the ice falling passage, the ice cubes will fall randomly, and even pop out of the ice storage box 7 because of no restriction.

Figure 10:
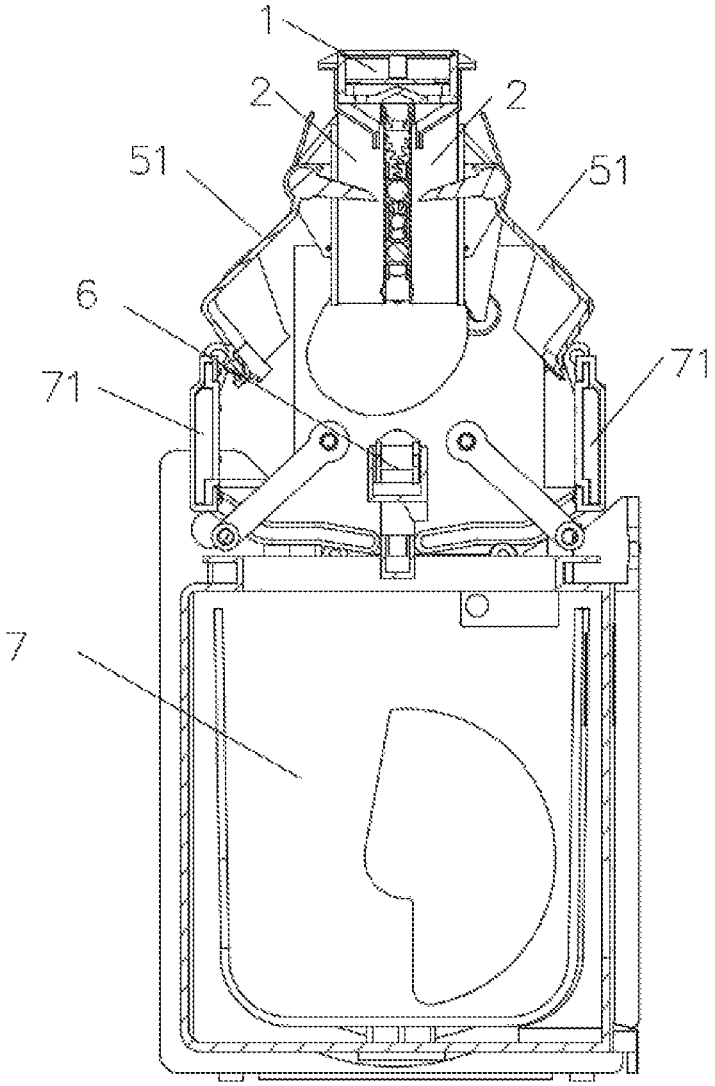
FIG. 10 is a longitudinal cross-sectional view of a water diversion ice rake structure in an ice making system at an ice falling position according to an embodiment of the present application.

FIG. 10 is a longitudinal cross-sectional view of a water diversion ice rake structure at an ice falling position according to the present embodiment. As shown in FIG. 10, at the ice falling position described in this embodiment, the free ends of the pair of water receiving lateral wings 51 are separated from each other to form an ice falling passage from the ice falling port toward the ice inlet of the ice storage box 7, and the ice cubes fall into the ice storage box 7 via the ice falling passage for storage.

Lateral Wing

In this embodiment, condensed water and splashed water are intercepted by the closure space formed by the pair of water receiving lateral wings 51, and the condensed water and the splashed water are avoided from dripping into the ice storage box 7 which affects the quality and accuracy of the ice cubes.

It should be noted here that during deicing, the deiced ice cubes are firstly collected in the closure space. After the deicing is completed, the pair of water receiving lateral wings 51 are rotated in opposite directions to open the ice falling passage, and all ice cubes fall into the ice storage box 7 along the ice falling passage. Specifically, when the ice cubes fall, the water receiving lateral wings 51 form a shield that prevents ice cubes from falling outside the ice falling passage, which may guide the ice cubes to fall into the ice storage box 7 totally and accurately. Here, "rotating in opposite directions" means directions opposite to the directions in which the pair of water receiving lateral wings 51 are rotated toward the ice making position.

According to an embodiment of the present application, as shown in FIG. 9, the ice making assembly includes at least one ice tray 2. The ice tray 2 includes a plurality of ice tray units arranged side by side, and an evaporator or other cooling unit is disposed on the backside of the ice tray 2 for cooling the ice tray 2. When ice is made normally in the ice tray 2, water flows over the water flowing surface of each ice tray unit of the ice tray 2, and the water is gradually condensed into ice when it is cooled. As shown in FIG. 1, a heating wire 4 on the backside of the ice tray 2 is configured to heat the ice tray 2 for deicing when needed.

According to an embodiment of the present application, in order to speed up deicing, as shown in FIGS. 2 to 5, the water diversion ice rake structure 5 further includes ice rake teeth 52, which are disposed at the rotary end of at least one water receiving lateral wing 51 and face the ice outlet side of the ice making assembly. Namely, from which side of the ice making assembly ice is out, the corresponding side is provided with the ice rake teeth 52. During deicing, the rotary end of the water receiving lateral wing 51 rotates, while the water receiving lateral wing 51 is driven to rotate, the ice rake teeth 52 are driven to rotate to push the ice cubes to fall into the ice storage box 7 along the ice falling passage. Applying thrust to the ice cubes through the ice rake teeth 52, on the one hand, may help the ice cubes to quickly leave the ice tray 2 and save deicing time, and on the other hand, may give the ice cubes a thrust in a specified direction to increase the orderliness of falling of ice cubes.

When ice is made normally in the ice tray 2, the ice rake teeth 52 do not affect the normal ice making. Specifically, the ice rake teeth 52 are inclined toward the water flowing surface of the ice tray 2, and the top ends of the ice rake teeth 52 are close to the water inlet of the ice tray 2.

When the adhesive force between the ice cube and the ice tray 2 is small, as shown in FIG. 10, the ice rake teeth 52 are driven to rotate under the rotation of the rotary end of the water receiving lateral wing 51, and a thrust is applied to the water outlet 53 of the ice tray 2 from the water inlet of the ice tray 2, that is, from the upper end of the ice cubes, thereby saving the energy used for heating, ensuring ice cubes having small melting surfaces and good quality, as well as enabling the ice cubes to fall smoothly into the ice storage box 7 along the water outlet 53 of the ice tray 2.

In an embodiment, in order to improve the ice making efficiency, the ice making assembly includes a pair of ice trays 2, and backsides of the pair of ice trays 2 are disposed opposite to each other, as shown in FIGS. 9 and 10. Combined as shown in FIG. 1, an evaporator 3 and a heating wire 4 are arranged between the pair of ice trays 2, and the evaporator 3 and/or air cooling are used to provide cold capacity to the ice tray 2 to make ice. After the ice making is completed, the ice tray 2 is heated by the heating wire 4 or a heating tube so that the ice cubes are separated from the ice tray 2 to ensure smooth ice falling.

According to an embodiment of the present application, when a pair of ice trays 2 is provided, the rotary ends of the pair of water receiving lateral wings 51 may be provided with ice rake teeth 52, that is, the ice rake teeth 52 are provided on one side of each ice tray 2 to assist in the deicing of each ice tray 2 respectively, so as to maintain the consistency of the ice falling from the ice trays 2 on both sides.

According to an embodiment of the present application, in a case that a pair of ice trays 2 are provided, a pair of ice inlets are provided at intervals at the upper end of the ice storage box 7, the water collecting tank 6 is disposed above the pair of ice inlets, and the length direction of the water collecting tank 6 is along the length direction of the ice storage box 7. In addition, in order to ensure that ice cubes may smoothly fall into the ice storage box 7 without falling into the water collecting tank 6, the width of the water collecting tank 6 should not be too large. Further, the side wall of the water collecting tank 6 may also be used as a shield when the ice cubes fall, and the ice falling passage is divided into two ice falling areas to facilitate the ice cubes falling from the ice trays 2 on both sides respectively.

Ice doors 71 are hinged outside the pair of ice inlets on the ice storage box 7. "Outside" here refers to the side of the ice inlet away from the water collecting tank 6. The ice door 71 is driven to rotate by a hinged shaft, and opens and closes in horizontal and vertical states. Specifically, when the ice door 71 is in the closed state, it is horizontally arranged at the ice inlet, and the ice door 71 is vertically arranged in the open state. The free end of the water receiving lateral wing 51 on the corresponding side abuts against the upper end of the ice door 71, so that a continuous shielding side wall is formed from the water receiving lateral wing 51 to the ice door 71, which may reliably guide and shield the ice cubes, and ensure that the ice cubes will not be ejected out from the ice storage box 7.

Of course, it is also possible to arrange only one ice door 71 as needed.

According to an embodiment of the present application, the ice rake tooth 52 tapers from its root outward along a length direction to form a tip, so as to facilitate the application of thrust to the ice cubes, and to avoid interference with the ice tray 2 during the rotation process.

According to an embodiment of the present application, the ice tray 2 includes a plurality of ice tray units disposed side by side, allowing multiple ice cubes to be made at the same time so as to improve ice making efficiency. A plurality of ice rake teeth 52 are disposed at intervals along a length direction of the rotary end of the water receiving lateral wing 51, and the plurality of ice rake teeth 52 are in one-to-one correspondence with the plurality of ice tray units. During deicing, the plurality of ice rake teeth 52 are rotated at the same time to push the ice cubes in the corresponding ice tray units out of the ice tray units.

Figure 6:
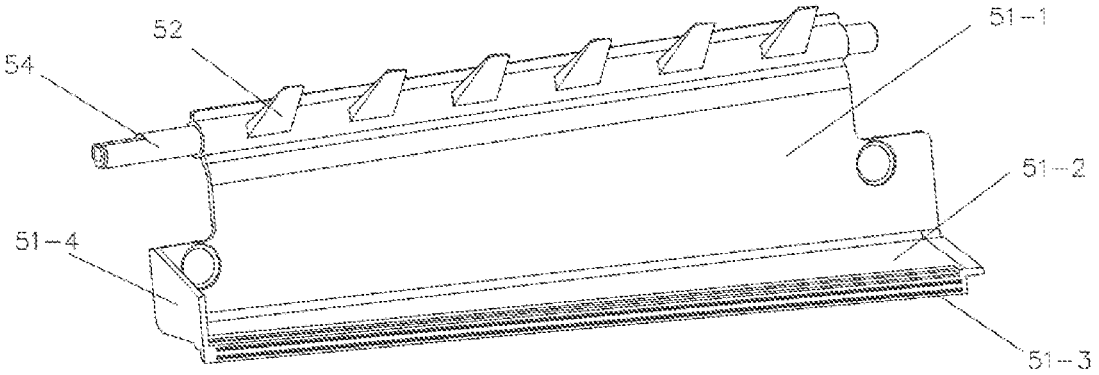
FIG. 6 is a schematic structural diagram of a water receiving lateral wing on one side of a water diversion ice rake structure according to an embodiment of the present application.
Figure 7:
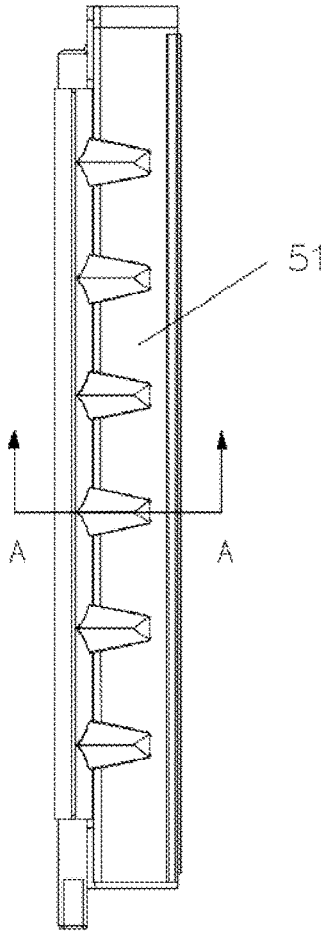
FIG. 7 is a top view of a water receiving lateral wing on one side of a water diversion ice rake structure according to an embodiment of the present application.
Figure 8:
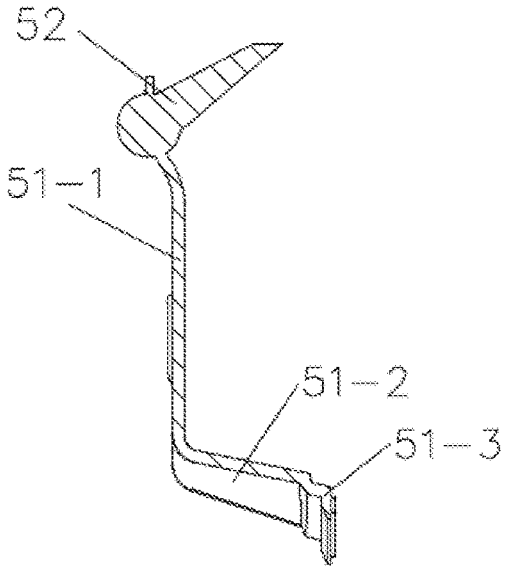
FIG. 8 is a cross-sectional view of A-A in FIG. 7.

FIGS. 6 to 8 are schematic diagrams showing the structure of the water receiving lateral wings of this embodiment. As shown in FIGS. 6 to 8, according to an embodiment of the present application, each of the pair of water receiving lateral wings 51 includes a water stopping side wall 51-1 extending downward along the respective rotary end and a water receiving side wall 51-2 extending to the opposite from the water stopping side wall 51-1 and inclined downward, forming a rough L-shaped structure. In order to optimize the structure, the junction of the water stopping side wall 51-1 and the water receiving side wall 51-2 is in a circular arc transition connection.

In order to have a larger contact area after the pair of water receiving lateral wings 51 are butted, and to ensure the reliability of the connection and prevent water leakage, in this embodiment, a downwardly extending flanging 51-3 is provided at a bottom end of the water receiving side wall 51-2.

In order to ensure the hermeticity of the pair of water receiving lateral wings 51 after being butted, in an embodiment, the bottom end of at least one water receiving side wall 51-2 is provided with a sealing structure 55 extending to the flanging 51-3, and the sealing structure 55 may be a silicone pad, food grade rubber pad, etc. In order to ensure the hermetic effect, for example, a silicone pad may be provided at the bottom end of one water receiving side wall 51-2, and the silicone pad has an extension end extending outward. The bottom end of the other water receiving side wall 51-2 is provided with a groove. After the pair of water receiving lateral wings 51 are butted, the extension end of the silicone pad extends into the groove. In addition, the silicone pad extending to the flanging 51-3 is clamped between a pair of water receiving side walls 51-2, and thus good hermeticity effect is provided. Moreover, the outer surface of the silicone pad may also be provided with a sawtooth structure, and a matching sawtooth structure is provided on the opposite flanging, so as to further ensure sufficient hermeticity.

According to an embodiment of the present application, as shown in FIG. 6, in order to ensure that the water collected in the closure space may flow smoothly to the water outlet 53, the water receiving side wall 51-2 is configured to be inclined toward the water outlet 53, and is open on a side provided with the water outlet 53 to facilitate the flow of water, and is provided with a shielding wall 51-4 on a side away from the water outlet 53 to prevent water from flowing out of the water collecting tank 6 from the other side of the water receiving side wall 51-2.

According to an embodiment of the present application, in order to facilitate the rotational connection of the pair of water receiving lateral wings 51 and the ice making assembly, each of the rotary ends of the pair of water receiving lateral wings 51 is provided with a rotary shaft 54 whose axial direction extends along a length direction of the ice making assembly, to drive the water receiving lateral wings 51 to open and close along the length direction of the ice making assembly.

In order to fix the position of the water receiving lateral wing 51, the rotary shaft 54 of the water receiving lateral wing 51 may be fixed to the side wall of the ice making assembly through a bearing seat.

According to an embodiment of the present application, as shown in FIG. 1, in order to automatically drive the water receiving lateral wing 51 to rotate, a driving mechanism is further included. The driving mechanism is connected to the rotary shaft 54 of one of the water receiving lateral wings 51. The driving mechanism may be a driving motor 9 whose output shaft is connected with a driving interface of the rotary shaft 54, and the rotary shaft 54 is driven to rotate synchronously through the rotation of the driving motor 9.

In order to reduce the number of driving motors 9 and save costs, the rotary shafts 54 of the pair of water receiving lateral wings 51 are connected to each other through a linkage 56. That is, the driving motor 9 drives one water receiving lateral wing 51 to rotate, and the other water receiving lateral wing 51 is driven to rotate synchronously through the linkage 56. In this embodiment, the linkage 56 may be a pair of gears that mesh with each other, or may be a partial gear structure provided with meshing teeth, such as a sector-toothed sector structure, or, may also be other structures such as a connecting rod, as long as it can ensure the opening or closing of the pair of water receiving lateral wings 51. It should be understood, of course, that in an alternative embodiment, it is also feasible to equip a driving mechanism for each of the pair of water receiving lateral wings 51, depending on the specific usage conditions, which is not defined in the present application.

According to an embodiment of the present application, the ice making assembly further includes a water outflow mechanism. As shown in FIG. 1, the water outflow mechanism includes a water distributor 1 which supplies water evenly to each ice tray unit through water distribution branch hoses in one-to-one correspondence with the ice tray units, so as to achieve the consistency of ice cube forming in each ice tray unit.

In addition, the water collecting tank 6 is connected to a water tank 11 through a drain hose, a water pump 12 is provided on the drain hose, and the water distributor 1 is connected to the water tank 11. Through the work of the water pump 12, the water in the water collecting tank 6 is discharged into the water tank 11 through the drain hose, and thus the ice making water is recycled.

In this embodiment, a water stopper, such as a water retaining cover, is provided on an outer side of a connection between the water outlet 53 and the water collecting tank 6, to prevent the water flowing out of the water outlet 53 from splashing out of the water collecting tank 6.

In an embodiment of the present application, as shown in FIG. 1, the ice storage box 7 is provided with an ice discharging mechanism 8 which is connected to an ice discharging motor, and the ice discharging mechanism 8 is driven to rotate by the ice discharging motor to achieve automatic ice discharging.

Specifically, the ice discharging mechanism 8 may be a spiral shaft. When the spiral shaft rotates, the ice cubes move along a spiral groove of the spiral shaft to facilitate ice discharging.

Specifically, the water outflow mechanism is connected to the water tank 11, and the water in the water tank 11 and the collected water in the water collecting tank 6 are supplied to the ice tray 2 through the water outflow mechanism to make ice. A water valve 10 is arranged on a connecting pipeline between the water distributor 1 and the water tank 11 and may be switched on and off according to the demand of ice making. A water level detector is mounted in the water tank 11 and configured to detect the height of the water level, and when the water level drops to a preset value, the outside will be notified to supply water to the water tank 11. The ice making system is disposed in a housing on which an observation door 13 is provided, and the internal operation of the ice making system may be observed through the observation door 13.

In a second aspect, an embodiment of the present application further provides a refrigeration apparatus, including but not limited to a refrigerator, which includes the ice making system in the above-mentioned technical solutions.

Since the refrigeration apparatus of the embodiment of the present application includes the ice making system described above, it may not only solve the problems of condensed water dripping out and water splashing outward during ice making caused by internal components of the ice making system, but also ensure that the ice cubes fall accurately into the ice storage box. The refrigeration apparatus is convenient to use, and the ice cubes made are of good quality and high precision.

The above are only example embodiments of the present application, and are not intended to limit the present application. Any modification, equivalent substitution, improvement and the like made within the principle of the present application shall be included in the protection scope of the present application.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An ice making system, comprising:

an ice making assembly;

a water collecting tank located below the ice making assembly; and a water diversion ice rake structure including:

a pair of water receiving lateral wings, each of which is constructed with a rotary end and a free end; the pair of water receiving lateral wings are rotatably disposed on opposite sides of the ice making assembly through the respective rotary ends to rotate between an ice making position and an ice falling position;

wherein at the ice making position, the free ends of the pair of water receiving lateral wings are butted in a space between the ice making assembly and the water collecting tank to form a closure space with an opening facing the ice making assembly, and a water outlet communicating with the water collecting tank is formed on one side of the closure space; and wherein at the ice falling position, the free ends of the pair of water receiving lateral wings are separated from each other to form an ice falling port.

2. The ice making system of claim 1, further comprising an ice storage box located below the ice making assembly, wherein an ice inlet is provided at an upper end of the ice storage box; and wherein at the ice falling position, the free ends of the pair of water receiving lateral wings are separated from each other to form an ice falling passage from the ice falling port toward the ice inlet.

3. The ice making system of claim 2, wherein a pair of ice inlets are disposed at intervals at the upper end of the ice storage box, and the water collecting tank is disposed above a position between the pair of ice inlets; and ice doors are hinged on outer sides of the pair of ice inlets on the ice storage box.

4. The ice making system of claim 1, wherein the ice making assembly comprises at least one ice tray, and the ice tray includes a plurality of ice tray units disposed side by side.

5. The ice making system of claim 4, wherein the ice making assembly comprises a pair of ice trays, and backsides of the pair of ice trays are disposed opposite to each other.

6. The ice making system of claim 4, wherein the water diversion ice rake structure further comprises ice rake teeth which are provided at the rotary end of at least one of the water receiving lateral wings, the ice rake teeth are inclined toward a water flowing surface of the ice tray, and a top end of the ice rake teeth is close to a water inlet of the ice tray.

7. The ice making system of claim 6, wherein the ice rake tooth tapers from its root outward along a length direction to form a tip.

8. The ice making system of claim 6, wherein a plurality of ice rake teeth are disposed at intervals along a length direction of the rotary end of the water receiving lateral wing, and the plurality of ice rake teeth are in one-to-one correspondence with the plurality of ice tray units.

9. The ice making system of claim 1, wherein each of the pair of water receiving lateral wings comprises a water stopping side wall extending downward along the respective rotary end and a water receiving side wall extending to the opposite from the water stopping side wall and inclined downward; and a bottom end of the water receiving side wall is provided with a downwardly extending flanging.

10. The ice making system of claim 9, wherein the bottom end of at least one of the water receiving side walls is provided with a sealing structure extending to the flanging.

11. The ice making system of claim 9, wherein the water receiving side wall is constructed to be inclined toward the water outlet, and a side located at the water outlet of the water receiving side wall is open and a side away from the water outlet thereof is provided with a shielding wall.

12. The ice making system of claim 9, wherein each of the rotary ends of the pair of water receiving lateral wings is provided with a rotary shaft whose axial direction extends along a length direction of the ice making assembly.

13. The ice making system of claim 12, further comprising a driving mechanism which is connected with the rotary shaft of one of the water receiving lateral wings, and the rotary shafts of the pair of the water receiving lateral wings are connected to each other through a linkage.

14. The ice making system of claim 8, wherein the ice making assembly further comprises a water outflow mechanism, the water outflow mechanism includes a water distributor which supplies water to each ice tray unit through water distribution branch hoses in one-to-one correspondence with the ice tray units;

the water collecting tank is connected to a water tank through a drain hose, a water pump is provided on the drain hose, and the water distributor is connected to the water tank; and a water stopper is provided on an outer side of a connection between the water outlet and the water collecting tank.

15. A refrigeration apparatus, comprising:

a body including a cabinet and a door coupled to the cabinet;

an ice making system in the cabinet, the ice making system including:

an ice making assembly;

a water collecting tank located below the ice making assembly; and a water diversion ice rake structure including:

a pair of water receiving lateral wings, each of which is constructed with a rotary end and a free end; the pair of water receiving lateral wings are rotatably disposed on opposite sides of the ice making assembly through the respective rotary ends to rotate between an ice making position and an ice falling position;

wherein at the ice making position, the free ends of the pair of water receiving lateral wings are butted in a space between the ice making assembly and the water collecting tank to form a closure space with an opening facing the ice making assembly, and a water outlet communicating with the water collecting tank is formed on one side of the closure space; and wherein at the ice falling position, the free ends of the pair of water receiving lateral wings are separated from each other to form an ice falling port.

16. The refrigeration apparatus of claim 15, wherein the ice making system further comprising an ice storage box located below the ice making assembly, wherein an ice inlet is provided at an upper end of the ice storage box; and wherein at the ice falling position, the free ends of the pair of water receiving lateral wings are separated from each other to form an ice falling passage from the ice falling port toward the ice inlet.

17. The refrigeration apparatus of claim 16, wherein a pair of ice inlets are disposed at intervals at the upper end of the ice storage box, and the water collecting tank is disposed above a position between the pair of ice inlets; and ice doors are hinged on outer sides of the pair of ice inlets on the ice storage box.

18. The refrigeration apparatus of claim 15, wherein the ice making assembly comprises at least one ice tray, and the ice tray includes a plurality of ice tray units disposed side by side, wherein the water diversion ice rake structure further comprises ice rake teeth which are provided at the rotary end of at least one of the water receiving lateral wings, the ice rake teeth are inclined toward a water flowing surface of the ice tray, and a top end of the ice rake teeth is close to a water inlet of the ice tray.

19. The refrigeration apparatus of claim 15, wherein the ice making assembly comprises at least one ice tray, and the ice tray includes a plurality of ice tray units disposed side by side, wherein a plurality of ice rake teeth are disposed at intervals along a length direction of the rotary end of the water receiving lateral wing, and the plurality of ice rake teeth are in one-to-one correspondence with the plurality of ice tray units.

20. The refrigeration apparatus of claim 1, wherein each of the pair of water receiving lateral wings comprises a water stopping side wall extending downward along the respective rotary end and a water receiving side wall extending to the opposite from the water stopping side wall and inclined downward; and a bottom end of the water receiving side wall is provided with a downwardly extending flanging.

* * * * *